US008851964B2

(12) United States Patent
Gross et al.

(10) Patent No.: US 8,851,964 B2
(45) Date of Patent: Oct. 7, 2014

(54) POKER GAME WITH SHARED COMMON CARD

(76) Inventors: E. Mark Gross, New Rochelle, NY (US); Brian Z. Lando, West Orange, NJ (US)

( * ) Notice: Subject to any disclaimer, the term of this patent is extended or adjusted under 35 U.S.C. 154(b) by 935 days.

(21) Appl. No.: 12/302,888

(22) PCT Filed: Sep. 28, 2006

(86) PCT No.: PCT/US2006/037736

§ 371 (c)(1),
(2), (4) Date: Nov. 30, 2008

(87) PCT Pub. No.: WO2007/142665

PCT Pub. Date: Dec. 13, 2007

(65) Prior Publication Data

US 2009/0264174 A1 Oct. 22, 2009

Related U.S. Application Data

(60) Provisional application No. 60/810,849, filed on Jun. 5, 2006.

(51) Int. Cl.

| | |
|---|---|
| ***A63F 9/24*** | (2006.01) |
| ***A63F 3/00*** | (2006.01) |
| ***G07F 17/32*** | (2006.01) |
| *A63F 1/00* | (2006.01) |

(52) U.S. Cl.

CPC ..... *A63F 1/00* (2013.01); *A63F 2001/005* (2013.01); *A63F 3/00157* (2013.01); *G07F 17/3288* (2013.01); *G07F 17/32* (2013.01); *G07F 17/3293* (2013.01)

USPC ..... 463/13

(58) Field of Classification Search

None

See application file for complete search history.

(56) References Cited

U.S. PATENT DOCUMENTS

| | | | | |
|---|---|---|---|---|
| 2002/0190469 | A1 * | 12/2002 | Conklin et al. | 273/292 |
| 2003/0073476 | A1 * | 4/2003 | Friedman | 463/13 |
| 2005/0194742 | A1 * | 9/2005 | Donaldson | 273/292 |
| 2006/0119044 | A1 * | 6/2006 | Kekempanos et al. | 273/292 |

* cited by examiner

*Primary Examiner* — David E Graybill

(74) *Attorney, Agent, or Firm* — Law Offices of Mitchell P. Novick

(57) ABSTRACT

A method of playing a variation of Texas Hold'em poker in which each player is dealt three hole cards instead of the usual two. A player sets his three cards into two Texas Hold'em type hands, each having two cards, by selecting from among the three cards one card that is shared with each of the other two cards to form a two-card hand. Except for each player playing two hands, the rules of play are those of a traditional Texas Hold'em game with flop, turn and river board cards, and betting rounds after display of the flop, turn and river board cards. In two variations of the game, the players select their shared cards either prior to or after display of the board flop cards. Also, the shared cards can be opened either at the time they are selected or after the round of betting that follows display of the river card.

17 Claims, 3 Drawing Sheets

POKER GAME WITH SHARED COMMON CARD

RELATED APPLICATION

This application claims the priority of U.S. provisional application Ser. No. 60/810,849 filed on Jun. 5, 2006.

FIELD OF THE INVENTION

The present invention relates generally to poker games and more particularly to a new poker card game, called Double Hold'em, in which players, playing in a physical setting or virtually on a computer system, in effect play two hands at the same time. Although the invention has particular advantage in on-line (communication network) applications, the invention is explained in the context of poker played in a home game or in a casino.

BACKGROUND OF THE INVENTION

Poker has always been a popular card game. Given the increasing Internet penetration into society at large that has enabled substantial on-line play and the growth in television coverage of poker tournament events, the increase of poker play—both in home games and real and on-line virtual casinos—has been marked during the past several years.

There are many variations of poker, with popularity of a version being somewhat dependent upon factors including, but not limited to (1) the ready understanding of the rules set; (2) ease of play from the player's perspective; (3) rules which benefit experienced and knowledgeable players (poker players view themselves as engaged in an activity requiring skill rather than pure luck, although luck is a factor which adds to the game); (4) rules which create multiple playable hands in each dealt hand, thereby allowing many players to share each hand's play experience; (5) the game's ability to accommodate multiple players, without any chance of there being inadequate cards in a standard 52-card deck to complete game play; (6) ease of play from the house's perspective, in the scenario of a physical or an on-line casino; (7) play which can be accomplished, for each hand, in a discrete limited amount of time; and (8) requisite interest level to support running the game in a physical or on-line casino.

The game of Texas Hold'em amply satisfies many of the above criteria and is a very popular poker game. Because the present invention is a variation of Texas Hold'em, it is necessary to review the way the traditional game is played. Texas Hold'em is played with a minimum of two players and usually up to a maximum of ten players. A standard 52-card deck is used, a deck with four suits, Clubs, Diamonds, Hearts and Spades, each having thirteen cards, 2, 3, 4, 5, 6, 7, 8, 9, 10, Jack, Queen, King and Ace. Cards are shuffled before each hand, to a degree of complete randomness.

At the outset of play, each player receives two cards face down ('hole cards'). Five cards are turned up in the center of the table and are used by all players. Players may use any combination of their two hole cards plus the five community cards on the table (also known as the 'board') to make the best five-card poker hand. Ranking of hands is the conventional ranking, with the highest hand being 10, Jack, Queen, King and Ace on-suit (the highest straight-flush) and the lowest potential winning hand being high cards (when there is no pair or better hand). Two or more players may tie, in which event each receives an equal share from the pot created by the betting. All suits are equal in value in determining a winner. A flush of one suit against a flush of the same cards in another suit results in a tied hand.

At the outset of table play in many casino settings, a face up card is dealt from the deck to each player at the table, and the high-card recipient (as to card value, Club, Diamond, Heart, Spade is the ascending order of value, Ace of Spades being the highest card) is designated the first 'button' (dealer) position with 'blinds' (to be described below) clockwise from this position.

Actions may be taken by a player only when it is his turn to act. In structured games, betting limits double after the 'turn' (to be described below) is dealt. At any time, to 'call' a player must put in either the amount of chips of the bet(s) made in that betting round prior to his turn, or his entire amount of chips ('stack') at the table. If ever a player bets his whole stack—which is less than the bet(s) prior to or after his turn—another player's exposure to that player is equal only to the amount of that player's whole stack invested in the pot. As to such a player, known as 'all in,' and the player(s) he competes with through the 'river' (to be described below), players who later fold not being considered, the hand will always be fully dealt out, with a winner declared, using all board cards. After a player or players go 'all in,' betting can continue by other players. When this happens, separate 'side' pots can be created for the players who continue betting and calling one another. These side pots are won by the continuing players, and in these hands two or more players can be declared winners (even if the 'all in' player makes the best hand, the continuing player with the next highest hand will win the side pot). Depending on the site rules, a player or player may have the above 'all in' rules apply to him (even if he has chips), in instances where he benefits from a 'disconnect protect.' A disconnect protect allows a player to avoid being folded from an on-line game if the game server perceives that he has been disconnected from the server.

In 'no limit' games, any player can bet his stack or any portion of it, but with a minimum 'call' of the lesser of the bet(s) made in that betting round prior to his turn or his stack. All raisers can raise their entire stacks or any portions of them but with a minimum of the lesser of the entire stack or the amount of chips of the bet being raised (e.g., a prior raise of $20 can be re-raised by an amount of $40 or more). If ever a player bets his whole stack, side pots are created as described above.

In 'pot limit' games, a player can bet up to the amount of chips in the pot to that point (including previous bets made in that round), or any portion thereof but with a minimum of the lesser of the value of the largest blind in that hand or his stack if his stack is less than the largest blind amount. To 'call,' a player must put in the lesser of either the bet(s) made in that betting round prior to his turn or his whole stack. All raisers can raise up to their entire stack (subject to the pot limit criteria above) or any portion thereof but with a minimum of the lesser of the entire stack or the amount of the bet being raised. If ever a player bets his whole stack, side pots can ensue.

The first player to the left of the dealer button must bet 'in the blind' before any cards are dealt. (In some games, two or more blinds are required.) After the blinds are posted, two cards ('hole' cards) are dealt 'down' (unseen by other players, and only to be played as part of the recipient's hand) to each player. After this, proceeding in a clockwise order from the blind bettor(s), each player may call the blind bet(s), raise or fold. Players required to bet 'in the blind' have an option to raise their blind bets on the first round of betting, with the farthest-clockwise-away blind bettor being the last to act in the initial betting round. At any time, a hand will conclude if there is only one remaining player still 'in' (not folded, while all others have folded), and if this happens that sole player is declared the winner and the pot is given to that player.

After the first round of betting, the first three board cards are simultaneously turned up (the 'flop') as community cards. Then each player who is still 'in,' starting with the first 'in' player to the left of the button, may check, bet, call, raise, re-raise (re-raises may be limited to three in any round) or fold. The betting round is complete when there are no more parties left to act, and when there are no more bets or raises which have not been called or responded to by an all-in or fold.

A fourth card is then turned up (the 'turn') on the board as a community card, and betting proceeds for the remaining 'in' players as described above. Finally, a fifth and last card is turned up (the 'river') on the board as a community card, and betting proceeds for the remaining 'in' players. After the river round betting is complete, the last bettor's hole cards are opened and 'read' to determine the strength of that hand when combined with the five board cards, and the same reading of hands is then done in clockwise order with respect to the hole cards of each player still 'in.' The winner(s) are declared and the pot is distributed.

After each hand, the dealer-button moves clockwise to the next player, placing that player in the dealer position. The next hand then commences.

There may be minor regional variations to elements of the game, which are not part of the above description, and which are known in the art. These are not critical to understanding the invention described herein. An example of a commonly known feature is the 'rake' that is often taken by the house/casino, so that it profits from the game. A casino or poker site does not traditionally bet with players. Instead, it charges players a fee for its hosting/supervising the game. There are typically two kinds of fees: entry fees charged in tournaments, and a rake collected from ring game pots (fees vary depending upon the games stakes, how far the hand goes and/or the pot's size). Rake is not further described herein, since inclusion of a rake does not affect the desirable qualities of the subject invention.

While the game of Texas Hold'em satisfies many of the criteria discussed above, on many if not most hands the game does not provide many players with what might be generally viewed as playable hands. As a result, in many circumstances of play, three players or fewer at a ten-player table play a hand beyond what is called the pre-flop stage (before any community cards are turned up).

Since a player starts with two cards, there are 169 distinct starting hands in Texas Hold'em. (Excluding permutations associated with specific suits, as suits are irrelevant to hand strength, there are 13 times 13, or 169, combinations. This recognizes suited hands such as 8 and 9 of Spades as different from an unsuited 8, 9 hand.) The following rankings of the 169 starting hands, ordered from best to worst, are based on one published methodology but alternative methodologies that give rise to other orderings are possible. The letters T, J, Q, K and A refer to a card of value ten, Jack, Queen, King and Ace, respectively. The notation 's' in the table after two cards means that the two cards are of the same suit. The notation 'o' (off-suit) means that the two cards are of different suits—pairs are understood to be off-suit with no notation required.

| Rank | Cards |
|---|---|
| 1 | AA |
| 2 | KK |
| 3 | QQ |
| 4 | AKs |
| 5 | JJ |
| 6 | AQs |
| 7 | KQs |
| 8 | AJs |
| 9 | KJs |
| 10 | TT |
| 11 | AKo |
| 12 | ATs |
| 13 | QJs |
| 14 | KTs |
| 15 | QTs |
| 16 | JTs |
| 17 | 99 |
| 18 | AQo |
| 19 | A9s |
| 20 | KQo |
| 21 | 88 |
| 22 | K9s |
| 23 | T9s |
| 24 | A8s |
| 25 | Q9s |
| 26 | J9s |
| 27 | AJo |
| 28 | A5s |
| 29 | 77 |
| 30 | A7s |
| 31 | KJo |
| 32 | A4s |
| 33 | A3s |
| 34 | A6s |
| 35 | QJo |
| 36 | 66 |
| 37 | K8s |
| 38 | T8s |
| 39 | A2s |
| 40 | 98s |
| 41 | J8s |
| 42 | ATo |
| 43 | Q8s |
| 44 | K7s |
| 45 | KTo |
| 46 | 55 |
| 47 | JTo |
| 48 | 87s |
| 49 | QTo |
| 50 | 44 |
| 51 | 22 |
| 52 | 33 |
| 53 | K6s |
| 54 | 97s |
| 55 | K5s |
| 56 | 76s |
| 57 | T7s |
| 58 | K4s |
| 59 | K2s |
| 60 | K3s |
| 61 | Q7s |
| 62 | 86s |
| 63 | 65s |
| 64 | J7s |
| 65 | 54s |
| 66 | Q6s |
| 67 | 75s |
| 68 | 96s |
| 69 | Q5s |
| 70 | 64s |
| 71 | Q4s |
| 72 | Q3s |
| 73 | T9o |
| 74 | T6s |
| 75 | Q2s |
| 76 | A9o |
| 77 | 53s |
| 78 | 85s |
| 79 | J6s |

-continued

| Rank | Cards |
|---|---|
| 80 | J9o |
| 81 | K9o |
| 82 | J5s |
| 83 | Q9o |
| 84 | 43s |
| 85 | 74s |
| 86 | J4s |
| 87 | J3s |
| 88 | 95s |
| 89 | J2s |
| 90 | 63s |
| 91 | A8o |
| 92 | 52s |
| 93 | T5s |
| 94 | 84s |
| 95 | T4s |
| 96 | T3s |
| 97 | 42s |
| 98 | T2s |
| 99 | 98o |
| 100 | T8o |
| 101 | A5o |
| 102 | A7o |
| 103 | 73s |
| 104 | A4o |
| 105 | 32s |
| 106 | 94s |
| 107 | 93s |
| 108 | J8o |
| 109 | A3o |
| 110 | 62s |
| 111 | 92s |
| 112 | K8o |
| 113 | A6o |
| 114 | 87o |
| 115 | Q8o |
| 116 | 83s |
| 117 | A2o |
| 118 | 82s |
| 119 | 97o |
| 120 | 72s |
| 121 | 76o |
| 122 | K7o |
| 123 | 65o |
| 124 | T7o |
| 125 | K6o |
| 126 | 86o |
| 127 | 54o |
| 128 | K5o |
| 129 | J7o |
| 130 | 75o |
| 131 | Q7o |
| 132 | K4o |
| 133 | K3o |
| 134 | 96o |
| 135 | K2o |
| 136 | 64o |
| 137 | Q6o |
| 138 | 53o |
| 139 | 85o |
| 140 | T6o |
| 141 | Q5o |
| 142 | 43o |
| 143 | Q4o |
| 144 | Q3o |
| 145 | 74o |
| 146 | Q2o |
| 147 | J6o |
| 148 | 63o |
| 149 | J5o |
| 150 | 95o |
| 151 | 52o |
| 152 | J4o |
| 153 | J3o |
| 154 | 42o |
| 155 | J2o |
| 156 | 84o |

-continued

| Rank | Cards |
|---|---|
| 157 | T5o |
| 158 | T4o |
| 159 | 32o |
| 160 | T3o |
| 161 | 73o |
| 162 | T2o |
| 163 | 62o |
| 164 | 94o |
| 165 | 93o |
| 166 | 92o |
| 167 | 83o |
| 168 | 82o |
| 169 | 72o |

A big factor in whether a dealt hand wins in the end is how strong it is at the beginning of the hand. Recognizing his typical hand's weakness, a player on average folds better than two of three hands dealt to him pre-flop (before any community cards are opened), so as to avoid voluntarily investing chips in the pot on inferior cards. There are many folds because under Texas Hold'em's rules (two hole cards to each player), each player has only one of the 169 distinct starting hands. Often, this sole hand is likely a substantial underdog to the better hands which might be held by another player in any given game.

Viewed another way, in Texas Hold'em, 70% of the players are not active for three quarters of the time since play entails four betting rounds (pre-flop, flop, turn and river) and 70% of the players fold during the pre-flop betting round. These 70% of the players are inactive and potentially bored for the final three betting rounds of each hand. Being unoccupied for three quarters of the time is inconsistent with a player's desire to be significantly involved in the game. This inconsistency undermines the recreational quality of the Texas Hold'em gaming experience.

SUMMARY OF THE INVENTION

In the 'Double Hold' em' game of our invention, at the outset of each hand each player receives three hole cards, not two. At some point in the hand, each player playing the hand configures (the "Configuration") his three cards into two 2-card sets, with a common card ("Common Card") being a member of each set. Each player plays both of his 2-card sets, in effect playing two hands. Each 2-card set ("hand") is played in conjunction with the five cards which open on the board (3 simultaneously as the 'flop,' then a 4th 'turn' card, and then the 5th 'river' card).

There are several Configuration related options for how Double Hold'em may be played, examples of which are:

Option A: Each player's Configuration is made prior to the flop, and no additional round of betting takes place at Configuration time.

Option B: Each player's Configuration is made after the flop, and no additional round of betting takes place at Configuration time.

Option C: Same as Option A or B above, but with an additional action of each player's Common Card being opened on the table, and with a betting round after the Common Cards are opened. There may be five betting rounds in total under this option. In a limit value game, an additional betting round can occur either as a first-round value (i.e., $5 at a $5/10 table), or at the higher/double value of the turn and river betting rounds.

Because Double Texas Hold'em provides each player with a choice as to Configuration, each player has potentially three choices on how to set his two hands—any one of a player's three hole cards may be used as his Common Card. Each player therefore has a significantly increased chance of having a value hand of interest. Moreover, a player may have an interest even in a hand with three low rank hole cards. He has choices concerning Configuration, and his three low rank hole cards may be valuable with boards that also contain low rank cards. A player may be the only player with a small straight, and he may be amply rewarded by taking down a large pot as players with high pairs and draws on other hands will not likely fold.

Double Texas Hold'em increases the likelihood that more players will play each hand. Each player can potentially play two separate hands, with a Common Card. By doubling the potential for good hands, the interest level in each round of play is increased, thereby likely increasing both the percentage of hands played by each player and the amount of money in each pot. The game is also appealing to good players because it reduces the effect of random luck on the outcome of a lengthy session of cards and rewards good play.

Looser players will also appreciate the game because it creates more hands of interest in which they can participate, as many randomly generated 3-card hands will contain at least one 2-card hand of interest to motivate a loose player to participate in a game that he might otherwise sit out. Moreover, by allowing a player to select his Common Card, the game increases the player's sense of control. This increased sense of control also adds to player enjoyment.

Except for each player playing two hands, the rules of play for Double Texas Hold'em are those of a traditional Texas Hold'em game.

BRIEF DESCRIPTION OF THE DRAWINGS

Further objects, features and advantages of the invention will become apparent upon consideration of the following detailed description in conjunction with the drawing, in which.

DETAILED DESCRIPTION

Figure 1:
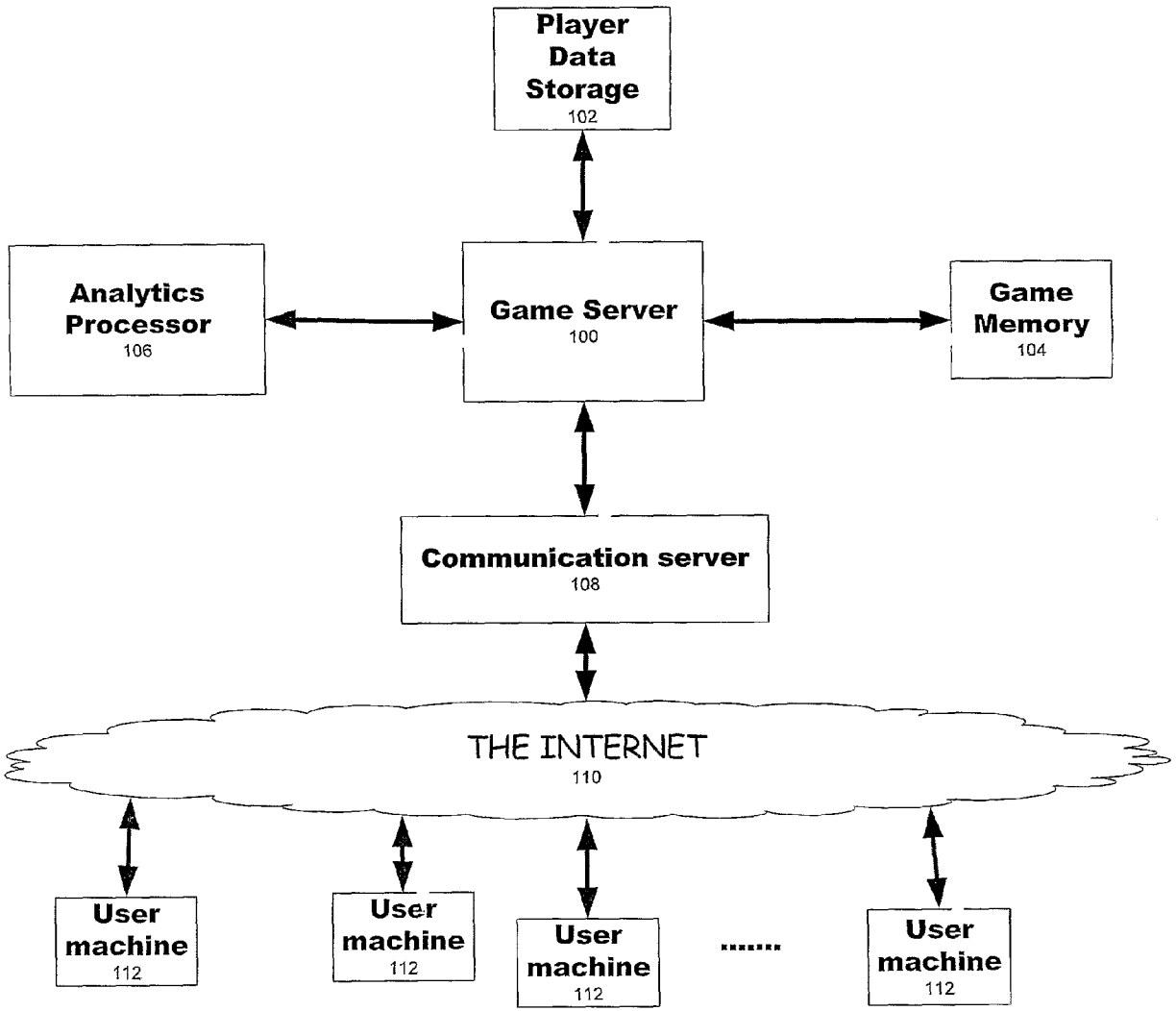
FIG. 1 depicts an overall system including a server machine which hosts an on-line poker game and enables play of the Double Hold'em poker game of our invention, and a plurality of user (client) machines.

The heart of the system of FIG. 1 is a game server 100, of which many examples exist in the prior art. The game server (which may be an array of processors) interfaces with two types of memory—player data storage 102 which maintains data pertaining to players who use the poker site, and game memory 104 which records data pertinent to games in progress. (Data collected during the course of games in progress may be used to update the player data storage so as to accumulate long-term information about players.) Analytics processor 106, which need not be a separate unit, performs game analyses and determines the information that is to be provided to players, including cards that are dealt and the naming of winners.

Communication server 108 transmits data to players and receives data from them, and transfers such data to and from the game server. The Internet 110 is the communications medium that connects user machines 112 to the server host. Although the Internet is the preferred communications medium, any other communication medium that has sufficient technological qualities, e.g., bandwidth, will suffice. There is nothing about the server or hardware that is unique and the hardware at any conventional poker hosting site can be used to implement the system and method of our invention.

Figure 2:
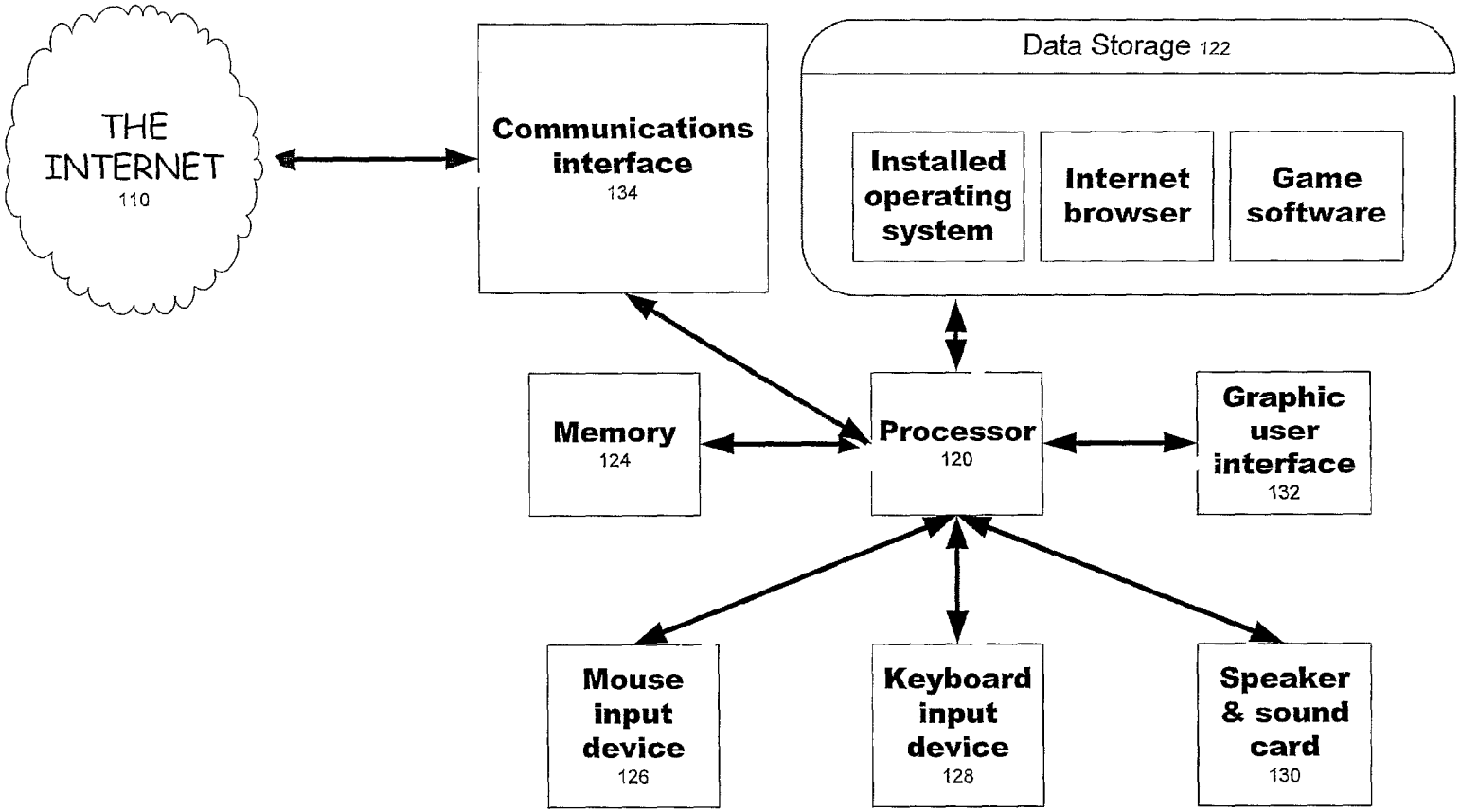
FIG. 2 depicts a user (client) machine which may be used by a person who plays poker on-line, including the Double Hold'em game of our invention.
Figure 3:
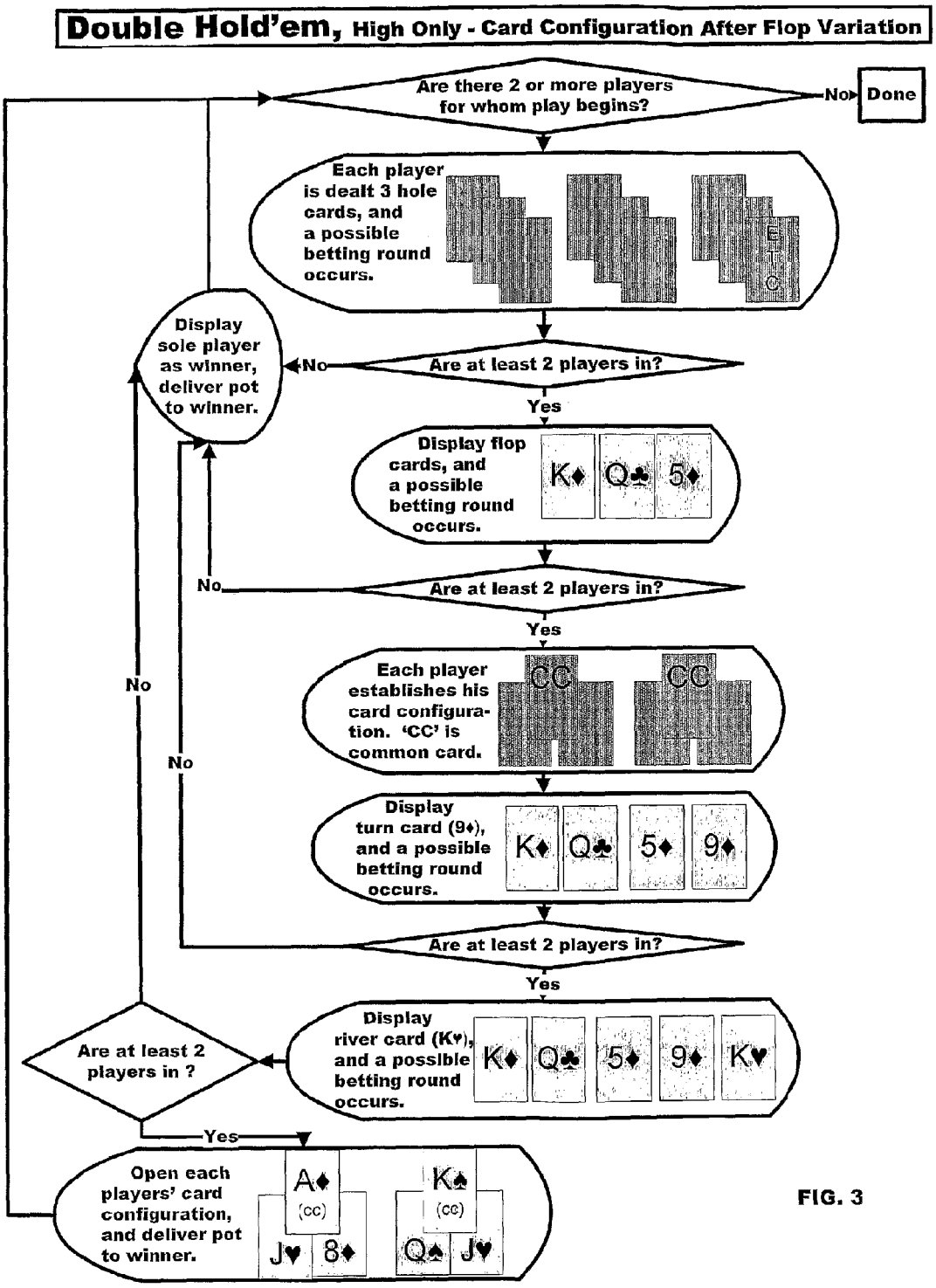
FIG. 3 depicts a representative hand of Double Hold'em being played out, within a schematic setting forth its rule set. The schematic demonstrates the appeal of the game, as various players have potential benefit (as the hand develops) from both of their card sets, as discussed below.

Similarly, the user client machines are also standard equipments, and conventional PCs can be used. A typical client machine, as shown in FIG. 2, includes a processor 120, memory 124 for storing data pertinent to a game in progress, and a conventional graphic user interface. Input/output devices include a mouse input device 126, a keyboard input device 128 and a speaker and sound card 130. In addition to memory 124 which stores temporary data, data storage 122 has the installed operating system, browser software and game software. The client machines are the same as those presently used by millions of people who play on-line poker.

To communicate over the Internet in general and to a game host in particular, the client machine includes a communication interface 134 which is shown connected to the Internet 110. (The invention may also be used in a physical setting, such as a casino, through play being networked and hosted on site. Such an implementation might utilize linked units, much like linked electronic slot machines, with appropriate back-end technology including servers, networking, etc.)

There are numerous features provided for today's on-line poker players. One such example is the ability to chat with other players. Another is the provision of sounds that accompany certain events on the virtual poker table displayed on the monitor of a player (e.g., the sound of a slot machine paying off when a pot is won by a player). While the embodiment of the invention disclosed herein emphasizes only the features necessary to understand the invention, it is to be understood that standard features of on-line gaming are also contemplated.

At the start of play, each player receives his three hole cards. Each player arranges his three cards into two hands; one Common Card is shared with each of the other cards. The formation of the cards—the Configuration—must make clear which is the Common Card. It may but need not be a V formation with the Common Card at the point (an L or other formation will also suffice). The player may not use his two cards which are not the Common Card to form a hand with the board cards.

Double Hold'em, as an option, may be played as a 'high-low' game. In this event, the player with the high hand will share equally in the pot with the player holding the low hand. A winning low in one form consists of five nonconsecutive cards of at least two suits (one of a player's 2-card sets with three or more of the board cards) which includes the lowest high card. If this card is matched in two hands, the players' next highest card(s) are compared to see whose is lower, until one player's compared card is lower—he is the low winner. Occasionally, the winning hand may be a pair or better, if all other hands contending for low are superior to this hand in strength. In this variation, the best low hand of five cards that can be achieved is A, 2, 3, 4 and 6 with at least two suits represented in the cards.

Another high-low Double Hold'em option considers the best low hand to be A, 2, 3, 4 and 5 with card suits of no consequence.

Finally, one variation of high-low Double Hold'em has a mandatory low in order for there to be a qualifying low hand. If there is no qualifying low hand, the high hand holder receives the entire pot. By way of example, an 8-low requirement would result in the worst qualifying low being 8, 7, 6, 5 and 4 (if straits do not disqualify low), or 3 (with cards off-suit, if straights and flushes do disqualify low).

It will be recognized that these several different forms of low variations are standard among many poker games. The invention here is not in the form of low game that is played. Each hand can be played as a low hand in any of the standard variations, just as each hand can be played as a high hand in any of standard variations. (Either hand, or even both, can even be played as both a high hand and a low hand in some poker game variations.) What is different here is giving each player two hands to play—a player is allowed to use both of his two-card hands to win respective low and high halves of the overall pot. What adds to the excitement and interest is that each player can make up his two hands in three possible ways, depending on which of his hole cards he chooses as the Common Card. It will be appreciated that the best way to win both high and low will often be to use an Ace as the Common Card.

The rules for opening a table, posting blinds and betting are not distinct to Double Hold'em. Standard Texas Hold'em rules and variations can apply to Double Hold'em play, provided that the 'double' hand feature is employed, whether the game is played in a home setting, a casino, or on-line.

As mentioned above, the game can be played in three different forms. In Option A, each player's Configuration is made prior to the flop, and no additional round of betting takes place at Configuration time. In Option B, each player's Configuration is made after the flop, and no additional round of betting takes place at Configuration time. Option C is the same as Option A or B, but with an additional action of each player's Common Card being opened on the table (rather than at the end of the game after the last round of betting), and, if desired, with a betting round after the Common Cards are opened.

An example of play of the game of the invention is depicted in the drawing. The particular variation depicted is that of a high-only game (only one winner), in which the players configure their hands after the flop and open their Common Cards (without an additional round of betting) at the end after the river card is opened (Option C). There is often more skill necessary to make an optimal selection of the Common Card if the selection is made after the flop cards are revealed. For ease of explanation, only two players are shown in the drawing playing beyond the pre-flop, although often many more players will play further into the hand.

The drawing is self-explanatory. At the start, three hole cards are dealt to each player, and a betting round occurs. If there is at least one 'blind' (a player who must bet on the opening round), then there is necessarily a round of betting. Otherwise, there is a round of betting only if one of the players makes a bet. As occurs after every betting round, the game proceeds only if there are still at least two players. If only one player remains, he is declared the winner.

The flop cards are then displayed, followed by a round of betting if one of the players makes a bet. In the drawing, an illustrative flop is shown. After the round of betting, the players establish their hands and choose their Common Cards. The turn and river cards are then uncovered, each followed by a possible round of betting. The players then open their other two hole cards and the winner is determined.

It should be noted that during the configuration step, the Common Card is placed at the apex of a 'V.' This is done so that a player's shared card is distinguished from his two other cards to indicate that his two other cards are not being played together as a hand. (Another possible template for the three cards is an 'L' with the shared card being placed at the corner.)

Consideration of the hands of the two players who were shown to play through the river in the drawing makes apparent why they stayed in to see the flop cards. (It is to be recalled that an object of the invention is to increase the number of players who stay in a game.) The left player shown in the bottom-most display has cards which may well support a flush, a straight, or high pairs. The right hand player also has cards which may well support a flush, a straight or high pairs. After seeing the flop, the left player sets his cards so the Ace is his Common Card, thereby assuring that he has the best possibility of realizing a flush or straight, although the flop gives him nothing but a high card hand with draw percentages. The right hand player shown in the bottom-most display sets his Common Card so that he has two pairs (had he set the Jack as his common card, he would have only a single pair). The turn card reverses who is ahead in the hand, by giving the left-hand player an Ace-high flush. This is superior to the two pairs held by the right hand player who, although he is behind now, has two draw hands—the chance to improve his two pairs into a full house using his left diagonal cards, and the chance to make a straight if a 10 opens on the river through using his right diagonal cards (he does not know that even if he makes this straight it will not win, as it is inferior to the flush held by his opponent). The river card once again reverses the lead, as the right-hand player has converted his pair of Kings and Queens into a full house (KKK and QQ).

In a variation of Double Hold'em that expands on the idea of using shared cards, the board has nine cards in the form of two intersecting lines of five cards, with one shared card. Each line is revealed in the pattern of three flop cards (shown by Fs), a turn card (shown by a T) and finally a river card (shown by an R) as follows:

| | | | | |
|---|---|---|---|---|
| | | F1<br>F1 | | |
| F2 | F2 | F12 | T2 | R2 |
| | | T1<br>R1 | | |

Although in this variation it is a flop card that is shared, the shared card can also be the turn card or the river card.

The players can use cards from either one line (F1 F1 F12 T1 R1) or the other (F2 F2 F12 T2 R2) but, with the exception of the shared card, not both. In a high-low game, a player can use either of his hands with one line to form his high hand and the other line to form his low hand.

In still another variation of Double Hold'em, the game can be played in a player-versus-house manner. In this case, play would occur at a table similar to the casino WPT (World Poker Tour) All-In Hold'em tables known to those familiar with casino card games, with each hand having a multitude of players (perhaps up to 10) competing against the house rather than each other. In any given hand, all players might win or lose, or some might win while others might lose. Play would commence after the players have placed their initial bets. Each player would then receive three cards and potentially after backing up his bet or surrendering, the above rules would apply to the player's Configuration of his three cards.

In one version, the casino would then open its three cards and configure them pursuant to predetermined rules, the board with all five community cards would then open (without player versus player betting rounds), and hand strength for both the house and the player would be determined using the rules of Double Texas Hold'em. All players with a hand of higher strength than the house's hand would win based on a predetermined schedule, and others would lose their bets. Alternatively, the comparison of hand strengths would only occur if the house has made minimum threshold hand strength, absent which the hand would be declared a tie. Additional winnings may be paid to the player if he has placed a bonus bet and made a minimum threshold hand strength all based on a predetermined schedule, absent which the bonus bet will be lost to the house. This kind of structure is well known to those familiar with the play of WPT All-in Hold'em and like casino player-versus-house poker table games.

In another version, the casino would open a board of five community cards (without player versus player betting rounds), and a player's hand strength would be determined using the rules of Double Texas Hold'em, the house having no competing hand. The player would lose if his hand is below a minimum threshold hand strength, or winnings would be paid out to him based on a predetermined schedule if a player meets the threshold level hand. This kind of structure is also well known to those familiar with the play of WPT All-In Hold'em and like casino player-versus-house poker table games.

It is well known in the poker world, that games with more action are more desirable. The Double Hold'em game provides this both in its player-versus-player format and also in its player-versus-house format, and has many other benefits over traditional Texas Hold'em. This is achieved without players having to learn a whole new game. It is easy to migrate from Texas Hold'em to Double Hold'em because the rules and feel of the game are so similar.

Although the invention has been described with reference to particular embodiments, it is to be understood that these embodiments are merely illustrative of the application of the principles of the invention. Thus it is to be understood that numerous modifications may be made in the illustrative embodiments of the invention and other arrangements may be devised without departing from the spirit and scope of the invention.

What is claimed is:

1. A method of playing a variation of Texas Hold'em poker in which a player is dealt three hole cards instead of a usual two hole cards and sets the three cards into two distinct Texas Hold'em hands each having two cards by selecting from among the three cards one shared card that is grouped with each non-shared card of the three cards to form the two hands, and in which the name is played on-line over a communication network.

2. A method of playing the variation of Texas Hold'em poker in accordance with claim 1 in which, except for the player playing the two distinct hands, rules of play are those of a traditional Texas Hold'em game.

3. A method of playing the variation of Texas Hold'em poker in accordance with claim 2 in which the player positions the cards so that the shared card is distinguished from the two non-shared cards to indicate that the two non-shared cards are not being played together as a hand.

4. A method of playing the variation of Texas Hold'em poker in accordance with claim 1 in which, except for the player playing the two distinct hands, rules of play are those of a traditional Texas Hold'em game with flop, turn and river board cards, and betting rounds after display of each of the flop, turn and river board cards.

5. A method of playing the variation of Texas Hold'em poker in accordance with claim 4 in which the player selects the shared card prior to display of the board flop cards.

6. A method of playing the variation of Texas Hold'em poker in accordance with claim 5 in which the player's shared card is displayed only after a last round of betting.

7. A method of playing the variation of Texas Hold'em poker in accordance with claim 5 in which the player's shared card is displayed after all shared cards are selected and before display of the board flop cards.

8. A method of playing the variation of Texas Hold'em poker in accordance with claim 4 in which the player selects the shared card after display of the board flop cards.

9. A method of playing the variation of Texas Hold'em poker in accordance with claim 8 in which the player's shared card is displayed only after a last round of betting.

10. A method of playing the variation of Texas Hold'em poker in accordance with claim 8 in which the player's shared card is displayed after all shared cards are selected and before display of the board turn card.

11. A method of playing the variation of Texas Hold'em poker in accordance with claim 4 in which the variation is played as a high-low game, and the player is allowed to use both of the distinct hands to win respective low and high halves of an overall pot.

12. A method of playing the variation of Texas Hold'em poker in accordance with claim 1 in which rules of play are those of a traditional Texas Hold'em game with flop, turn and river board cards, and with betting rounds after display of the flop, turn and river board cards, and in addition to the player playing the two distinct hands there are two series of board cards for flop, turn and river, only one of which series can be selected by the player for both of the hands.

13. A method of playing the variation of Texas Hold'em poker in accordance with claim 12 in which said two series of flop, turn and river board cards share a single card in common.

14. A method of playing the variation of Texas Hold'em poker in accordance with claim 1 in which the player plays only against a house hand, with the player winning if he has either of the two distinct hands better than the house hand.

15. A method of playing the variation of Texas Hold'em poker in accordance with claim 1 in which the player plays only against a house hand, with the player winning if he has either of the two distinct hands better than the house hand and the house has qualified by the house hand making a minimum threshold hand.

16. A method of playing the variation of Texas Hold'em poker in accordance with claim 1 in which the player wins a bonus if he has either of the two distinct hands making a predetermined threshold hand based on a payout schedule.

17. A method of playing the variation of Texas Hold'em poker in accordance with claim 1 in which the player plays only against a house, with the player losing if he has both of the two distinct hands failing to make a hand of a requisite strength or winning if he has either of the two distinct hands better than the hand of the requisite strength, and with payouts being based on a predetermined payout schedule.

* * * * *